United States Patent [19]

Wang

[11] Patent Number: 4,903,945

[45] Date of Patent: Feb. 27, 1990

[54] STAPLE REMOVER

[76] Inventor: Yun L. Wang, 424 Barrenwood Dr., Wadsworth, Ohio 44281

[21] Appl. No.: 173,267

[22] Filed: Mar. 25, 1988

[51] Int. Cl.[4] ..... B25C 11/02

[52] U.S. Cl. ..... 254/28

[58] Field of Search ..... 254/22, 28, 23, 21; 227/63

[56] References Cited

U.S. PATENT DOCUMENTS

| | | | |
|---|---|---|---|
| 2,553,660 | 5/1951 | Levendusky | 254/28 |
| 2,662,727 | 12/1953 | Yerkes | 254/28 |
| 4,674,727 | 6/1987 | McAlister | 254/28 |

*Primary Examiner*—Judy Hartman

*Attorney, Agent, or Firm*—Oldham & Oldham Co.

[57] ABSTRACT

A staple remover is provided comprising two levers pivotally coupled at one end and being movable towards one another at their other ends. A pair of extraction jaws are formed at the movable ends of the levers for engaging the underside of a staple embedded in a material to thereby lift the staple away from the material. The staple remover also comprising an engaging member located adjacent the extraction jaw in one of the levers and forming a slot with said extraction jaw. The engaging member will engage the upper surface of the staple to thereby anchor the staple at a middle portion thereof for clean and uniform withdrawal of the staple ends from the paper.

7 Claims, 2 Drawing Sheets

FIG.-1
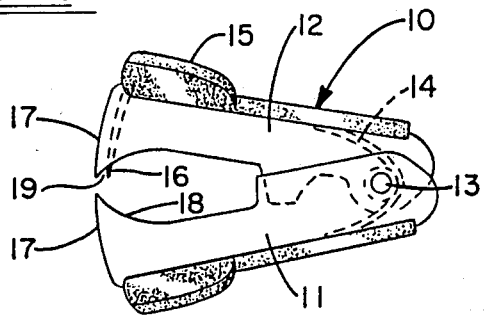
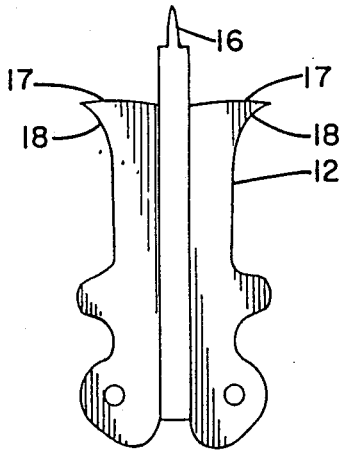
FIG.-3
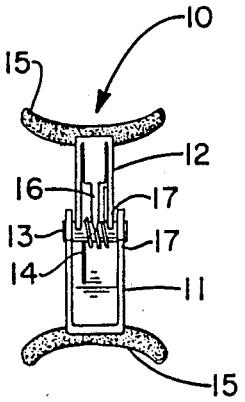
FIG.-2
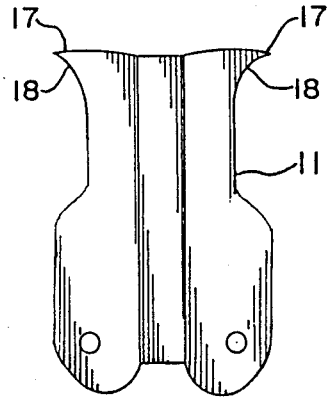
FIG.-4
FIG.8a
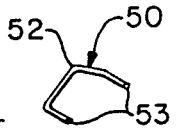
FIG.8b
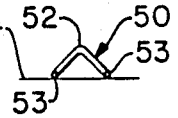
FIG.8c
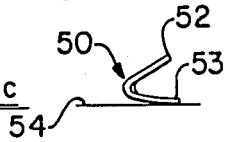

STAPLE REMOVER

BACKGROUND OF THE INVENTION

The invention relates to a staple remover suitable for extracting or withdrawing staples or similar fasteners from articles or bundles held together thereby. More particularly, the present invention relates to a staple extracting device which will accomplish removal of the staple without causing damage to the materials held together thereby, and will uniformly withdraw the staple ends.

The staples are utilized to secure materials together, such as paper, in such a manner that they are not easily detachable from each other. Frequently, it is desired to remove the staple so that the materials may be disengaged and separated. One such device which has been utilized in the prior art to remove staples, comprises a pair of levers connected at one end thereof and spring biased such that the levers are held in an open position with their opposite ends away from one another. The levers of the staple remover have at their other ends, engaging jaws, each having two projecting points facing the opposite lever. The points of each jaw are tapered away from these points creating a surface on which the staples will ride upon during removal. The points of each jaw are designed to overlap each other when the levers are brought together by a force applied thereto. In this way, the jaws may be positioned on opposite sides of a staple secured to a bundle of papers, and be made to engage the staple with these points. As the levers are brought together, the jaws will engage the underside of the staple which will be forced to ride up the tapered surfaces. As the staple rides up the tapered surfaces of the jaws, the ends thereof will be unbent from their secured position to thereby be removed from the paper bundle.

With such an apparatus, problems have been encountered in that the removal of a staple creates enlarged openings in the paper or other material and many times tears and damages the paper undesirably. Another drawback of such an apparatus is that very often one end of the embedded staple remains secured to the paper bundle making removal thereof very difficult and frustrating. These problems are due to the application of unequal forces to the two embedded sides of the staple. The forces applied by the apparatus may be unequal at times because of disproportionate resistance to unbending of the clinching staple ends or sometimes because of initial misalignment of the jaw engagement with the staple. The ends of the staple are therefore not always unbent uniformly and completely, and thus, tearing of the openings from the extraction of staple ends which are only partially straightened or incomplete extraction of the staple with a partially straightened end occurs.

It has, therefore, been found that a more effective staple remover is desirable which avoids the problems mentioned, and yet is simple in design and particularly easy to manufacture.

SUMMARY OF THE INVENTION

It is an object of the present invention to provide a staple remover having an engaging portion which will make contact with the middle portion of the staple in its embedded position to thereby assuredly remove a staple by the uniform and complete straightening of both staple ends. The engaging portion will make contact with the staple approximately simultaneously with the extracting jaws of the apparatus, and acts to anchor the middle portion of the staple for uniform straightening of the ends.

It is another object of the present invention to provide a mechanism whereby extraction of the staple from a paper bundle may be accomplished without enlarging or tearing the holes that were made by the staple initially.

It is also an object of the present invention to provide a device which will uniformly withdraw both legs of a staple simultaneously during extraction.

It is another object of the present invention to provide a device which will cause a staple to take on a non-planar configuration during extraction thereof. Such a non-planar configuration facilitates easy grasping of an extracted staple from a desk surface for disposal.

It is an additional object of the present invention to provide a method of manufacturing a staple extraction apparatus which does not require any additional steps to provide the advantages thereof, and which may be constructed in a simple and efficient manner.

The objects and advantages of the present invention are obtained by a staple extraction device comprising a first and second lever typically coupled at one end and having an extraction jaw at their opposite ends. The extraction jaw comprises a pair of points formed on each lever which extends towards the opposite lever and are engagable with the staple embedded in a bundle of papers or the like. The points of the extraction jaws taper back therefrom to each of the respective levers forming a surface upon which the staple once engaged will ride up and be extracted from the paper bundle.

The apparatus also comprises an engaging member located between the points of one extraction jaw and is extended toward the opposite lever adjacent the jaw points. The engaging member, which is generally shaped like a pin, is disposed above the bottom edge of the jaw and will engage the top side of the the staple substantially simultaneously to the engagement of the points of the extraction jaws to the underside of the staple. The engaging member acts to anchor the middle portion of the staple for proper application of force by the extracting jaws to thereby remove the staple legs neatly and uniformly from the paper bundle. The extraction device may be constructed of stamped metal members typically coupled at one end thereof and having the extraction jaws thereof spring biased to an open position. Alternatively, it may be constructed or and integrally formed resilient plastics spring and levers to which extraction jaws may be attached.

BRIEF DESCRIPTION OF THE DRAWING

The objects and advantages of the present invention may be more fully appreciated with reference to the description of the preferred embodiments and drawings wherein:

FIG. 1 is a side view of the extraction device of the present invention;

FIG. 2 is a bottom view of the apparatus showing the extraction jaws and engaging member thereof;

FIGS. 3 and 4 are plan views of the stamped metal pieces forming the extraction jaws of the present invention;

FIGS. 8 (*a*)-(*c*) show views of an extracted staple using the apparatus of the present invention.

It is understood that like reference characters refer to like elements throughout the several figures.

DETAILED DESCRIPTION OF THE INVENTION

Figure 5:
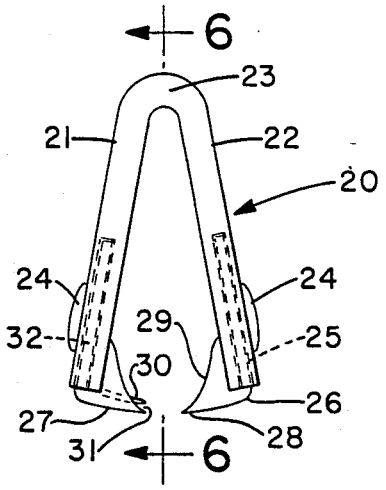
FIG. 5 is a side view of an alternate embodiment of the present invention.

The preferred embodiments of the present invention will be hereinafter described with reference to the figures. In FIG. 1, there is shown one embodiment of the present invention wherein the extraction device is shown generally by reference numeral 10. The device 10 comprises two levers, 11 and 12, pivotally connected at one end by means of a pin 13 extending through apertures therein. The levers 11 and 12 are shown in an open position, and being spring biased in this position by spring means 14. The levers 11 and 12 are, therefore, able to pivot toward one another at the opposite end of coupling. The levers 11 and 12 are provided with thumb or finger rests 15 such that a force may be applied with a user's hand to pivot the levers 11 and 12.

At the opposite end from coupling on the levers 11 and 12, are provided extraction jaws 17 having a pair of respective points engaging ends thereon for engaging a staple which is embedded in a paper bundle or the like. This structure is seen more clearly with reference to FIG. 2, wherein the extraction jaws 17 are more clearly shown with a pair of points formed on each respective jaw. The jaws 17 enable engagement with the head of a staple which is embedded in a paper bundle for extraction. The extraction jaws 17 provide a tapering surface 18 upon which the engaged staple will ride up when the levers 11 and 12 are pivoted towards one another, thereby extracting the embedded staple.

The description of the apparatus in FIG. 1 has been, until now, a standard construction for a staple remover as found in the prior art. In this invention is provided a separate engaging member 16 which facilitates removal of an embedded staple. As can be seen in FIG. 1, the engaging member 16 is positioned above and parallel to the lower edge of extraction jaw 17 on the lever 12. In this way, the engaging member 16 will not inhibit engagement of the points on extraction jaw 17 with the underside of the embedded staple. The engaging member 16 extends out between the points of extraction jaws 17, and projects to approximately the same extent as the points or at least to a plane which contains the engaging ends of extraction jaws 17 and the pivotal axis of the pair of levers 11 and 12 at pin 13. The end of the engaging member 16 and the two points of the extraction jaw 17 form a small gap or slot 19 as seen in FIG. 1. The slot 19 is of a suitable dimension such that the thickness of a staple wire will be accommodated therein, and will be wedged or anchored within the slot 19 upon initial engagement with the apparatus. The operation of the apparatus will be described more fully hereinafter, but it is to be said that the engaging member 16 facilitates proper removal of a staple embedded in a bundle of material by assuring the uniform and complete straightening of the staple ends during extraction.

It is seen with reference to FIG. 3, that the engaging member 16 is integrally constructed with the lever 12 from a stamped piece of metal which will be bent into the proper shape. The levers 11 and 12 are shown in FIGS. 3 and 4 as being stamped from a flat piece of metal, and formed with extracting jaw 17 having a pair of spaced apart oppositely positioned angular projections or points and tapering surfaces 18 thereon. The addition of a third projection or engaging member 16 adds no significant additional steps to the presently known manufacturing steps of such a device. The engaging member 16 may include a section having a greater width extending between the points of the extraction jaw 17 so as to provide reinforcement to the end thereof. The member 16 is simply stamped in conjunction with the lever 12 and is then bent into its position between and adjacent the points of extracting jaw 17. The lever 11 is constructed similarly to that of a presently known device, and comprises the extracting jaw 17 and tapered surfaces 18 which will be bent into their U-shaped position as shown in FIG. 2. The engaging member 16 may be incorporated in either lever, as desired, and will function in the same manner as described.

The operation of the device as shown in FIG. 1 is now described with reference to FIG. 7 showing different stages of operation to extract a staple 50 embedded in a paper bundle 51 or the like as shown in FIG. 7(*a*). The extraction jaws 17 associated with the lever 12 of FIG. 1 is shown in FIG. 7(*b*) and it is to be understood that the opposite lever 11 (not shown) will be engaging the staple 50 from the other side thereof for extraction of the staple. Engaging member 16 is shown as engaging the top portion of the staple 50 at a location near the middle thereof. The engaging member 16 may engage the staple 50 either simultaneously with or immediately after engagement of the points on extraction jaw 17 with the underside of staple 50. As shown in FIG. 7(*c*), the engaging member 16 will act to anchor the center of the staple 50 against the paper bundle 51 while the points of extraction jaw 17 lift the edges of the staple away from the paper. As the levers 11 and 12 are brought together, the staple 50 will be made to ride up the tapered surface 18 thereby straightening the ends and extracting the staple cleanly from the paper bundle 51 as shown in FIG. 7(*d*). The engaging member 16 still retains the middle portion of staple 50 anchored at a location near the paper in the formed slot 19 as shown in FIG. 1. By the anchoring operation of engaging member 16, the two staple legs are straightened independently and completely such that they are uniformly withdrawn from the paper bundle 51. The engaging member 16 will ensure that the force or straightening action applied to each of the staple legs is identical so that there is no possibility of a staple leg being retained in the paper bundle 51. It can be seen that the complete straightening of the legs on staple 50 by the action of engaging member 16 facilitates uniform withdrawal of the legs and proper removal of the staple without damaging or tearing the paper 51.

As the levers 11 and 12 are continually forced together, the staple 50 will be completely removed from the paper bundle 51 and is bent into a position as shown in FIG. 7(*e*) wherein the legs of the staple 50 will be drawn back from the gap 19 between the tapered surface 18 of the extraction jaw 17 and engaging member 16. In this way, the staple will have a raised portion at the middle thereof after removal from the paper bundle 51 to facilitate easy grasping for disposal thereof. This can be seen more particularly with reference to FIGS. 8(*a*)-(*c*). In FIG. 8(*a*), the resulting shape of an extracted staple using the present invention is shown in perspective. In FIGS. 8(*b*) and (*c*), it can be seen that the staple 50 has a portion 52 which extends upwardly from legs 53. The legs 53 will be flat on a planar surface 54 such that portion 52 projects away from the surface 54 facilitating easy grasping of the removed staple. It can be seen with reference to the operation of the extracting device, that the legs of the staple 50 are removed cleanly and uniformly from a paper bundle by means of engaging member 16.

Figure 6:
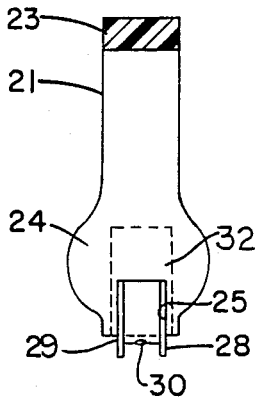
FIG. 6 is a cross-sectional view taken along the line 6—6 of FIG. 5.
Figure 7A:
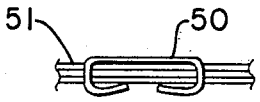
FIGS. 7 (*a*)-(*e*) show the sequence of staple extraction using the embodiments of the present invention.
Figure 7B:
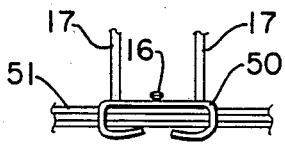
Figure 7C:
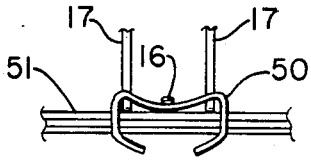
Figure 7D:
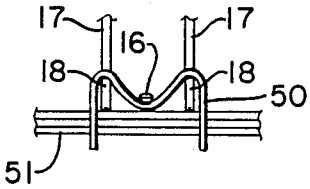
Figure 7E:
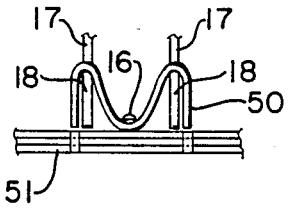

A second embodiment of the invention is shown with reference to FIGS. 5 and 6 wherein the extraction device is generally shown by reference numeral 20. The device 20 again comprises two levers 21 and 22 which are able to pivot towards one another from an initial open position. The levers 21 and 22 are formed integrally with a curved portion 23 providing the bias force necessary to keep the device in an initially opened position. The levers 21 and 22 and curved portion 23 are made of a resilient plastics material which will enable pivoting of the levers 21 and 22 towards one another and will then spring back to its original shape and open position. The use of such a plastics material obviates the need for separate levers which are coupled by means of a pin as shown in FIG. 1. The levers 21 and 22 may also be integrally formed with a thumb or finger rest 24 therein similarly to that shown in FIG. 1, but not requiring any fastening means. The device 20 may be formed by molding the plastics material, and also comprises a pair of slots 25 formed in the ends of levers 21 and 22. The slots 25 are produced to enable engagement with separate extracting jaw members 26 and 27. The extracting jaws 26 and 27 are formed similarly to that shown in FIG. 1 with points 28 having tapering surfaces 29 therefrom. As seen with reference to FIG. 7, the extracting jaws may be provided with a plate portion 32 which fits into the slotted portion 25 of the levers 21 and 22 to frictionally retain the extracting jaws therein. This structure eliminates the need for additional fastening means, but the extracting jaws 26 and 27 may be fastened to the levers 21 and 22 by any suitable fastening means if desired. A separate engaging member 30 is provided which extends between the points of extracting jaw 27 similarly to member 16 of FIG. 1.

It can be seen that the present invention improves the function of a staple removing device such that the staple may be easily removed without damaging or tearing the paper in which it is embedded, and it will extract the legs of a staple uniformly so that the staple is assuredly removed from the paper. It is seen that with the separate engaging member, as shown in the embodiments of the present invention, the objects and advantages of the present invention are realized in a very cost effective and easily manufactured method to provide an improved structure. While the preferred embodiments of the present invention have been disclosed herein, it will be appreciated that modification of these particular embodiments of the invention may be resorted to without departing from the scope of the invention as found in the appended claims.

What is claimed is:

1. A staple removing device comprising:

a pair of levers pivotally coupled at one end on an axis such that their other ends are capable of movement toward one another;

bias means acting on said levers for biasing said levers into an open position;

extraction means on said other end of said levers having engaging ends extending toward the other of said levers for engaging the underside of a staple embedded in a material to lift said staple away from said material;

an engaging means attached to one of said levers and located adjacent said extraction means extending substantially parallel to said extractions means but spaced therefrom for engaging the top side of a staple at about the center thereof simultaneously with engagement of said engaging ends of said extraction means with the underside of said staple;

said engaging means extends at least to a plane which includes said engaging ends of said extraction means and said pivotal axis of said levers;

wherein said engaging means will anchor said staple to said material at a middle portion thereof and the extraction means will uniformly withdraw the staple ends for removal.

2. A staple removing device as in claim 1, wherein;

said levers are constructed of a stamped metal sheet and coupled by means of a pin at one end thereof;

said engaging ends of said extraction means comprising a pair of points wherein said extraction means includes a tapering surface from said points back toward said levers.

3. A staple removing device as in claim 1, wherein;

said engaging means forms a slot with said extraction means having a dimension such that the thickness of a staple wire will be accommodated therein for anchoring of said wire within said slot substantially immediately upon engagement with the staple.

4. A staple removing device as in claim 1, wherein;

said engaging means will anchor the staple upon engagement therewith such that the force applied by said extraction means will be equalized on either side of said engaging means for uniform withdrawal of the staple.

5. A staple removing device as in claim 1, wherein;

said engaging means acts in conjunction with said extraction means so as to independently lift the legs of the staple for removal thereof.

6. A staple removing device as in claim 1, wherein;

said engaging means comprises a section having a greater width for reinforcement thereof.

7. A staple removing device as in claim 1, wherein;

said engaging means is constructed as an integral portion of said lever to which it is attached.

* * * * *